US010476203B2

(12) United States Patent
Oishi et al.

(10) Patent No.: US 10,476,203 B2
(45) Date of Patent: Nov. 12, 2019

(54) CONNECTOR

(71) Applicants: YAZAKI CORPORATION, Tokyo (JP); HONDA MOTOR CO., LTD., Tokyo (JP)

(72) Inventors: Kozo Oishi, Tochigi (JP); Tomoyuki Miyakawa, Tochigi (JP); Kazuyuki Ochiai, Saitama (JP); Daisuke Fujihira, Saitama (JP); Shintaro Matsuda, Saitama (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/219,877

(22) Filed: Dec. 13, 2018

(65) Prior Publication Data

US 2019/0123481 A1 Apr. 25, 2019

Related U.S. Application Data

(63) Continuation of application No. PCT/JP2017/014023, filed on Apr. 4, 2017.

(30) Foreign Application Priority Data

Jun. 15, 2016 (JP) ..... 2016-118790

(51) Int. Cl.
*H01R 13/627* (2006.01)
*H01R 13/52* (2006.01)
(Continued)

(52) U.S. Cl.
CPC ..... *H01R 13/627* (2013.01); *H01R 13/52* (2013.01); *H01R 13/6272* (2013.01);
(Continued)

(58) Field of Classification Search
CPC ... H01R 13/627; H01R 13/52; H01R 13/6272
(Continued)

(56) References Cited

U.S. PATENT DOCUMENTS 4,548,455 A * 10/1985 Ezure ..... H01R 13/627 439/152
5,575,683 A * 11/1996 Saito ..... H01R 13/4365 439/595
(Continued)

FOREIGN PATENT DOCUMENTS

JP 9-180818 A 7/1997
JP 9-219256 A 8/1997
(Continued)

OTHER PUBLICATIONS

Extended European search report for the related European Patent Application No. 17812987.0 dated May 9, 2019.
(Continued)

*Primary Examiner* — Alexander Gilman
(74) *Attorney, Agent, or Firm* — Kenealy Vaidya LLP

(57) ABSTRACT

A connector includes: a first connector which includes a tubular outer housing and an inner housing in which a plurality of first terminals are provided; a second connector which includes a bottomed tubular counterpart housing in which a plurality of second terminals are provided; and an elastic member which is provided in the outer housing and urges the inner housing toward a front side of the first connector in a fitting direction. The inner housing is moved by the elastic member to the front side in the fitting direction at the time of fitting.

8 Claims, 7 Drawing Sheets

(51) Int. Cl.
*H01R 13/64* (2006.01)
*H01R 13/639* (2006.01)
*H01R 13/635* (2006.01)
*H01R 13/631* (2006.01)

(52) U.S. Cl.
CPC ..... *H01R 13/639* (2013.01); *H01R 13/64* (2013.01); *H01R 13/631* (2013.01); *H01R 13/635* (2013.01)

(58) Field of Classification Search
USPC ..... 439/352
See application file for complete search history.

(56) References Cited

U.S. PATENT DOCUMENTS 5,791,930 A * 8/1998 Tabata ..... H01R 13/641 439/345
5,820,400 A 10/1998 Yamanashi et al.
5,827,086 A * 10/1998 Fukuda ..... H01R 13/6272 439/357
5,848,912 A 12/1998 Okabe
6,139,374 A * 10/2000 Kennedy ..... H01R 13/187 439/752
6,497,584 B1 * 12/2002 Murakami ..... H01R 13/641 439/352
6,517,373 B2 * 2/2003 Finke ..... H01R 13/6277 439/352
6,568,954 B2 * 5/2003 Endo ..... H01R 13/641 439/352
6,652,328 B2 * 11/2003 Suzuki ..... H01R 13/4365 439/595
6,679,719 B2 * 1/2004 Endo ..... H01R 13/641 439/352
6,688,907 B2 * 2/2004 Yamaoka ..... H01R 13/6272 439/188
6,840,790 B2 * 1/2005 Endo ..... H01R 13/641 439/352
7,043,834 B2 * 5/2006 Endo ..... H01R 13/641 29/842
7,101,213 B2 * 9/2006 Toyoda ..... H01R 13/6272 439/358
7,575,473 B2 * 8/2009 Kodama ..... H01R 13/6273 439/372
7,980,880 B2 * 7/2011 Kodama ..... H01R 13/6272 439/352
8,876,543 B2 * 11/2014 Oka ..... H01R 13/6272 439/353
9,270,055 B2 * 2/2016 Campbell ..... H01R 13/6272
9,705,248 B1 * 7/2017 Ko ..... H01R 13/6275
10,305,221 B2 * 5/2019 Ohfuku ..... H01R 13/641

FOREIGN PATENT DOCUMENTS

JP 9-245892 A 9/1997
JP 10-144399 A 5/1998

OTHER PUBLICATIONS

International Search Report and Written Opinion of the International Search Report for PCT/JP2017/014023 dated Jul. 11, 2017.
English language Written Opinion of the International Search Report for PCT/JP2017/014023 dated Jul. 11, 2017.

* cited by examiner 11
12
12A
12B
12C
12D
12G
13
13A
13B
13I
14
14F
15
20
21
22

11
12
12A
12B
12C
12D
12G
13
13A
13B
13I
14
14F
15
21
22
25

CONNECTOR

CROSS-REFERENCES TO RELATED APPLICATIONS

This application is a continuation of International Application No. PCT/JP2017/014023, which was filed on Apr. 4, 2017 based on Japanese Patent Application (No. 2016-118790) filed on Jun. 15, 2016, the contents of which are incorporated herein by reference.

TECHNICAL FIELD

The present invention relates to a connector in which a first connector is fitted to a second connector such that the connectors are connected with each other.

BACKGROUND ART

Generally, a connector includes a female connector and a male connector. For example, one of the conventional connectors has a tubular outer housing as a female connector and an inner housing which is received in the outer housing, and a plurality of female terminals are provided in the end surface of the inner housing. Further, the connector has a bottomed tubular counterpart housing as the male connector, and the plurality of male terminals are provided in the inner bottom surface of the counterpart housing. Further, when the male connector is fitted to the female connector, the end surface of the inner housing and the inner bottom surface of the counterpart housing are brought into close contact with each other, and the female terminal and the male terminal are connected electrically (for example, see JP-A-H09-180818).

SUMMARY

Incidentally, in JP-A-H09-180818, in the female connector, a coil spring is provided in the outer housing. By the coil spring, the inner housing is urged to the opening end side (a side on which the inner housing is fitted, that is, a front side in a fitting direction) of the outer housing. For this reason, when the male connector is fitted to the female connector, the housing of the male connector is inserted into the outer housing of the female connector against the urging force of the coil spring, and simultaneously the male terminal is necessarily pressed to the female terminal.

For this reason, JP-A-H09-180818, the insertion force of inserting the housing of the male connector into the outer housing of the female connector and a force of pressing the male terminal to the female terminal are required. Thus, an operating force of fitting the male connector to the female connector can be excessive.

The invention has been made in consideration of the above situation, and an object thereof is to provide a connector in which an operating force of fitting a male connector to a female connector can be reduced.

In order to achieve the above-described object, a "connector" according to an aspect of the invention is characterized by the following (1)-(4).

(1) A connector including:

a first connector which includes a tubular outer housing and an inner housing received in the outer housing and in which a plurality of first terminals are provided in the inner housing;

a second connector which includes a counterpart housing having a bottomed tubular shape and configured to receive the inner housing at a time of being inserted into the outer housing and in which a plurality of second terminals are provided in an inner surface of a bottom portion of the counterpart housing; and an elastic member which is provided in the outer housing and urges the inner housing toward a front side of the first connector in a fitting direction, wherein in a middle of fitting the first connector and the second connector, the second connector retreats the inner housing to a back surface of the first connector in the fitting direction against an urging force of the elastic member, and wherein at a time of completely fitting the first connector and the second connector, the second connector allows the elastic member to elastically return and moves the inner housing in the fitting direction to the front side of the first connector, so that the inner housing is guided toward the bottom portion of the counterpart housing, and the first terminal and the second terminal are connected with each other.

(2) A connector including:

a first connector which includes a tubular outer housing and an inner housing received in the outer housing and in which a plurality of first terminals are provided in the inner housing;

a second connector which includes a counterpart housing having a bottomed tubular shape and configured to receive the inner housing at a time of being inserted into the outer housing and in which a plurality of second terminals are provided in an inner surface of a bottom portion of the counterpart housing;

an elastic member which is provided in the outer housing and urges the inner housing toward a front side of the first connector in a fitting direction;

a first projection which is provided in an inner surface of the outer housing;

a second projection which is provided in an outer surface of the inner housing; and a lock member which is provided in an opening end of the counterpart housing, wherein in a middle of fitting the first connector and the second connector, the lock member abuts on the first projection so as to be deformed elastically in a direction toward the counterpart housing and butts the second projection to retreat the inner housing to a back surface of the first connector in the fitting direction against an urging force of the elastic member, and wherein at a time of completely fitting the first connector and the second connector, the lock member receives the second projection in a hole part provided in the lock member so as to elastically return in a direction away from the counterpart housing, and the lock member is released from butting the second projection such that the elastic member is allowed to elastically return to move the inner housing to the front side of the first connector, so that the inner housing is guided toward the bottom portion of the counterpart housing, and the first terminal and the second terminal are connected with each other.

(3) The connector according to (1) or (2), wherein the inner housing includes a conductive fitting detection member which detects a conduction of at least one pair of adjacent second terminals to detect a fitting state of the first connector and the second connector.

(4) The connector according to any one of (1) to (3), wherein the outer housing has a groove part, and wherein the inner housing includes an engagement projection which is engaged in the groove part to regulate a movement range of the inner housing.

(5) The connector according to any one of (1) to (4), further including:

a packing which is arranged to be interposed between an outer circumferential surface of the inner housing and an inner circumferential surface of the counterpart housing at the time of completely fitting the first connector and the second connector.

According to the connector configured as (1), when the second connector is fitted to the first connector, the timing of inserting the counterpart housing of the second connector to the outer housing of the first connector can be different from the timing of connecting the second terminal and the first terminal with each other. As a result, the insertion force of inserting the second connector to the first connector is not generated simultaneously with the force (for example, the force of pressing the second terminal to the first terminal) of connecting the first terminal and the second terminal with each other. It is possible to prevent that the operating force at the time of fitting the second connector to the first connector becomes excessive.

According to the connector configured as (2), the connector having the above-described effect can be configured specifically. That is, the above-described effect is exhibited by collaboration of the first projection provided in the inner surface of the outer housing, the second projection provided in the outer surface of the inner housing, and the lock member provided in the opening end of the counterpart housing.

According to the connector configured as (3), when the fitting detection member detects the conduction of the pair of adjacent second terminals, it can be determined that the fitting state of the second connector with respect to the first connector is complete.

According to the connector configured as (4), the engagement projection of the inner housing is engaged in the groove part of the outer housing so as to regulate the movement range of the inner housing. Thus, it can be prevented that the inner housing is deviated from the outer housing.

According to the connector configured as (5), the packing is interposed between the outer surface of the inner housing and the inner surface of the housing, so as to prevent that the water infiltrates into the portion provided with the first terminal or the second terminal.

According to the invention, it is possible to reduce the operating force at the time of fitting the male connector to the female connector.

BRIEF DESCRIPTION OF THE DRAWINGS

FIG. 1 is cut along a plan surface including line SA-SA.

FIGS. 7A-7D illustrate a procedure of fitting the male connector into the female connector, in which FIG. 7A is a view illustrating a state before the male connector is fitted to the female connector, FIG. 7B is a view illustrating an aspect where a lock member is deformed, FIG. 7C is a view illustrating an aspect where a projection is engaged in a hole part of the lock member, and FIG. 7D is a view illustrating an aspect where a male terminal is pressed to a female terminal.

FIGS. 8A-8D illustrate a procedure of fitting a male connector to a female connector in a second embodiment, in which FIG. 8A is a view illustrating a state where the male connector is fitted to the female connector, FIG. 8B is a view illustrating an aspect where the lock member is deformed, FIG. 8C is a view illustrating an aspect where the projection is engaged in the hole part of the lock member, and FIG. 8D is a view illustrating an aspect where a fitting detection member contacts the male terminal.

DETAILED DESCRIPTION

Hereinafter, an embodiment of a connector to which the invention is applied is described with reference to the drawings.

Embodiment

First Embodiment

Figure 1:
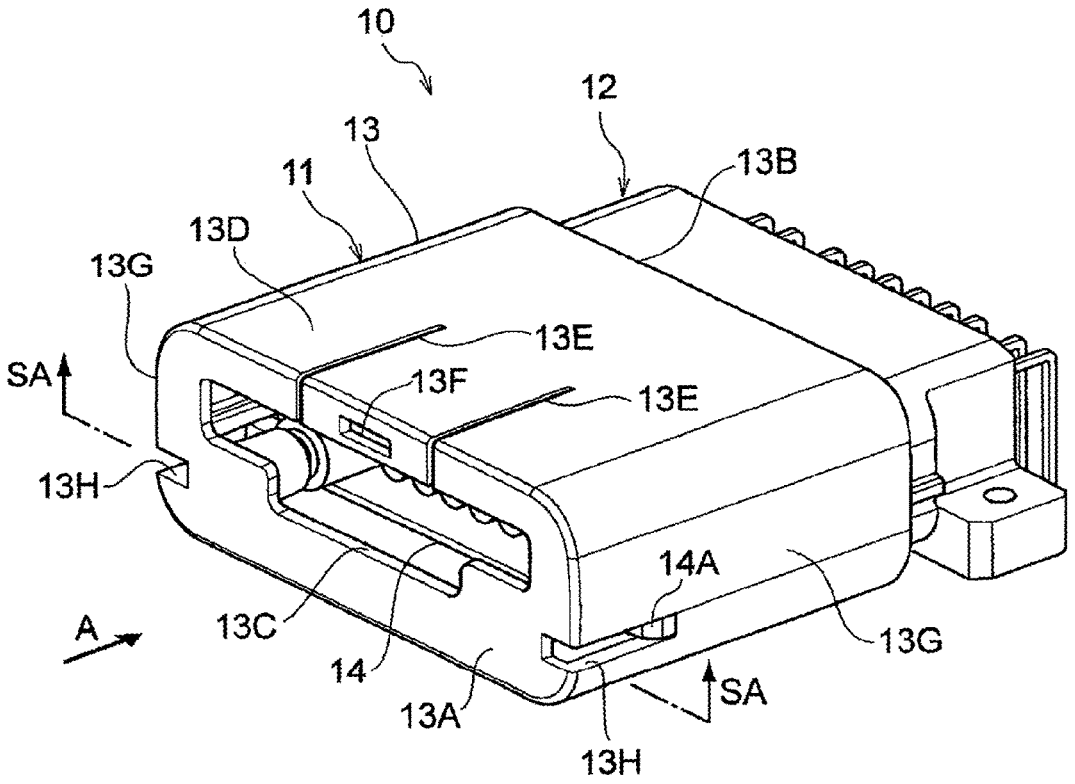
FIG. 1 is a perspective view of an appearance at the time of fitting a male connector to a female connector.
Figure 2:
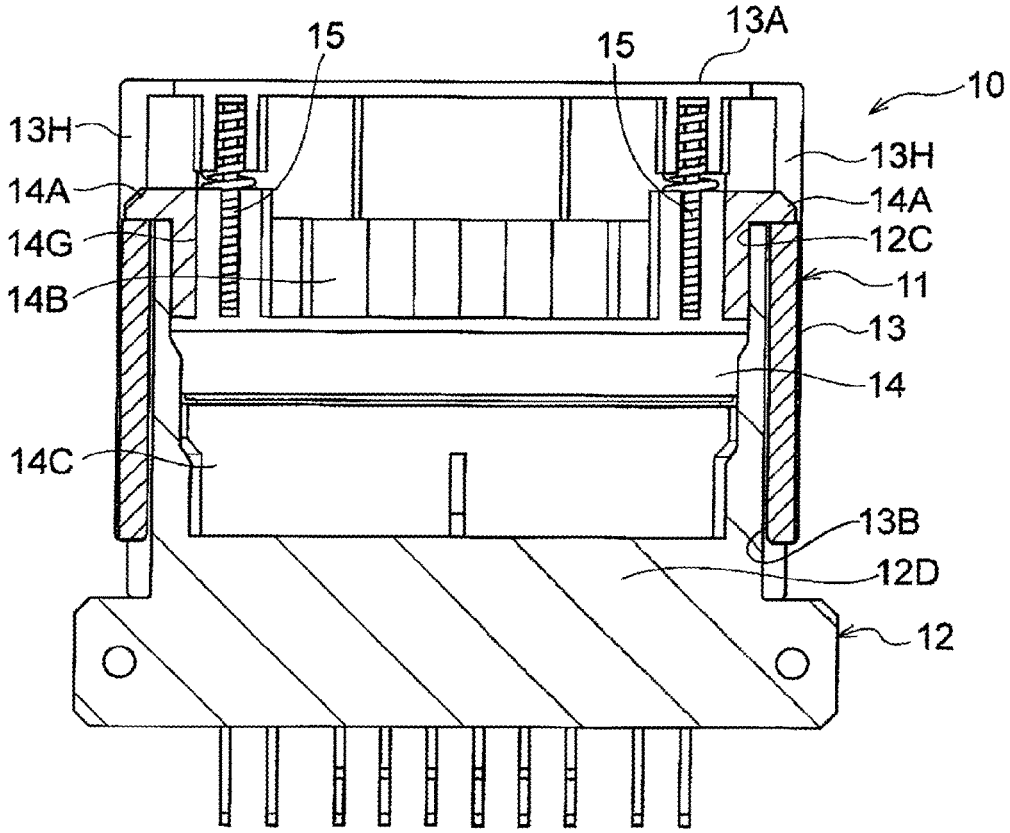
FIG. 2 is a sectional view illustrating an upper portion as seen from a lower side when

FIG. 1 is a perspective view of an appearance at the time of fitting a male connector to a female connector, and FIG. 2 is a sectional view illustrating an upper portion as seen from a lower side when FIG. 1 is cut along a horizontal plane including line SA-SA.

As illustrated in FIGS. 1 and 2, a connector 10 includes a female connector 11 as a first connector and a male connector 12 as a second connector. The female connector 11 has an outer housing 13 and an inner housing 14 which is received in the outer housing 13.

Figure 3:
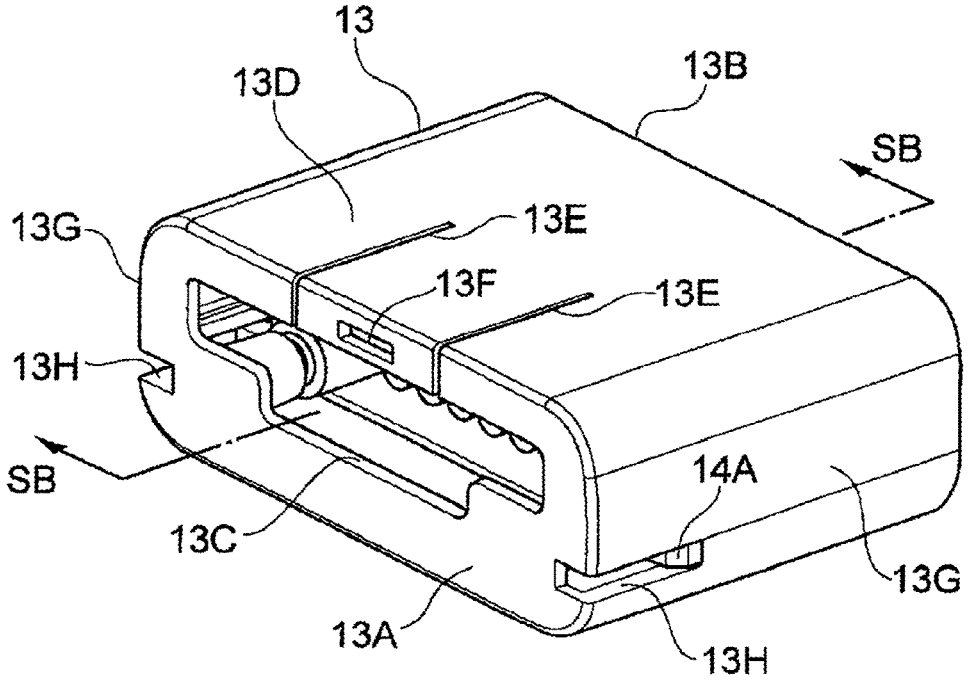
FIG. 3 is a perspective view of an appearance of an outer housing of the female connector, which receives an inner housing.
Figure 4:
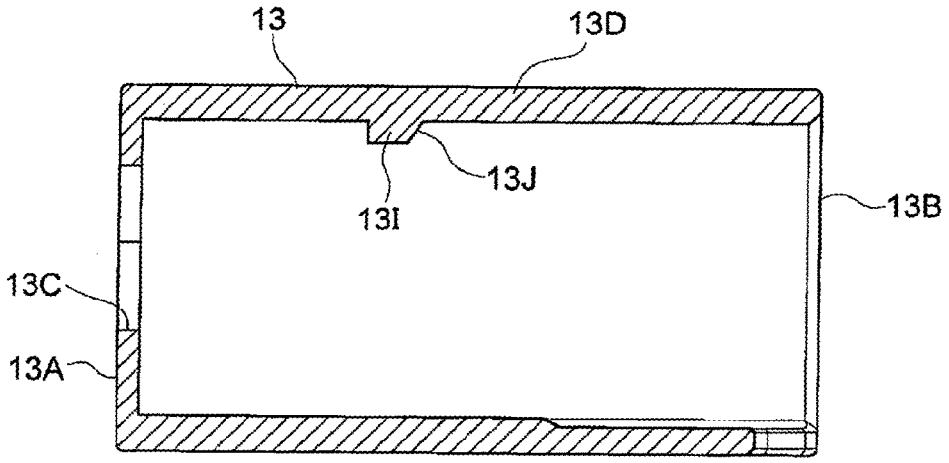
FIG. 4 is a sectional view taken along line SB-SB of FIG. 3.

As shown in FIG. 3, the outer housing 13 has a tubular shape, and includes an end wall 13A on one side (a left side in the drawing) and an opening end 13B on the other side (a right side in the drawing) (see also FIG. 4). As shown in FIG. 1, the outer housing 13 is formed in a substantially rectangular shape having four rounded corners as viewed from the arrow A.

In the outer housing 13, an opening part 13C is formed in the end wall 13A on the one side. In addition, in the outer housing 13, the inner housing 14 is inserted from the opening end 13B on the other side (see FIG. 2).

Two slits 13E and 13E are formed in an upper wall 13D and the end wall 13A (the upper portion of the opening part 13C in the end wall 13A) of the outer housing 13, respectively. In addition, in the end wall 13A, an operation hole 13F is formed between two slits 13E and 13E. Herein, the upper wall 13D and the end wall 13A are formed in a plate shape. The slits 13E and 13E are formed to penetrate the upper wall 13D or the end wall 13A. With such a configuration, when a human fingertip abuts on the operation hole 13F to pull up a portion between the slits 13E and 13E, a portion between the slits 13E and 13E in the upper wall 13D and the end wall 13A can be deformed upward.

In side walls 13G and 13G on both right and left sides of the outer housing 13, groove parts 13H and 13H are formed close to an end wall 13A, respectively. In the groove parts 13H and 13H, engagement projections 14A and 14A (see FIG. 2) provided on both right and left sides of the inner housing 14 are engaged respectively.

Herein, FIG. 4 is a sectional view taken along line SB-SB of FIG. 3. As illustrated in the drawing, one projection 131 is formed in the portion interposed between the slits 13E and 13E (see FIGS. 1 and 3) in the lower surface of the upper wall 13D of the outer housing 13 to protrude downward. One side surface (a right side surface in the drawing) of the projection 131 is formed obliquely such that the upper portion is close to the opening end 13B, and the lower portion is apart from the opening end 13B. That is, the projection 131 has an inclined surface 13J on a side close to the opening end 13B.

Figure 5:
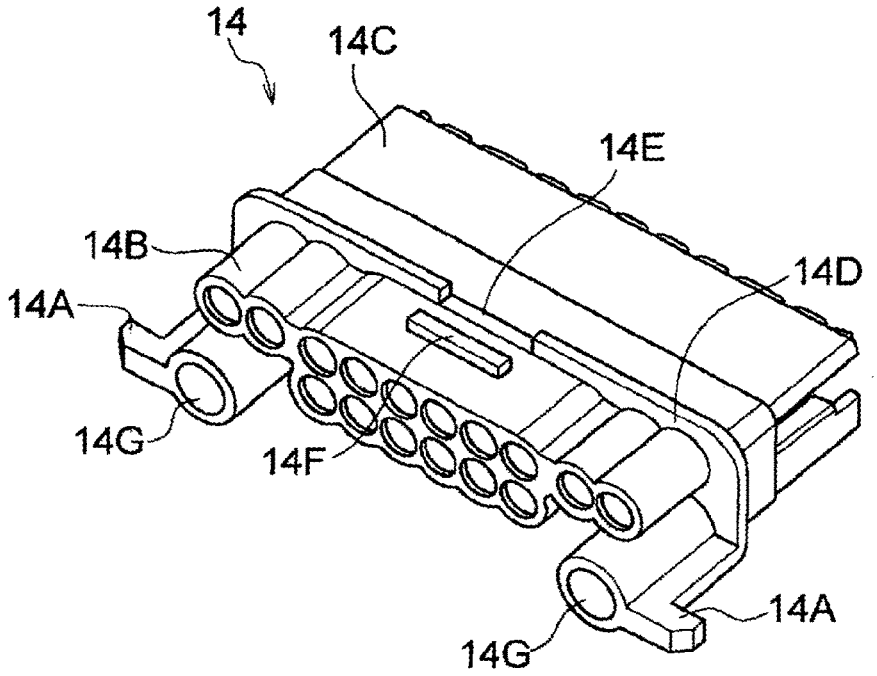
FIG. 5 is a perspective view of an appearance of the inner housing of the female connector.

As illustrated in FIG. 5, in the inner housing 14, portions having a circular hole are continuously arranged on one side (the left side in the drawing) thereof, and a lead-wire insertion part 14B into which a lead wire is inserted is provided in each of the circular holes. In addition, in the inner housing 14, a terminal attachment part 14C in which the lead wire is connected, and a plurality of female terminals 20 (see FIGS. 7A-7D) are attached as a first terminal is provided on the other side (the right side in the drawing). Incidentally, the lead wire is connected to the outside of the outer housing 13 through the opening part 13C formed in the end wall 13A of the outer housing 13.

The packing 22 (see FIGS. 7A-7D) is provided in the outer circumference of the terminal attachment part 14C, and the packing 22 is held to be positioned by a plate-shaped flange 14D provided between the lead-wire insertion part 14B and the terminal attachment part 14C.

The flange 14D is not provided in the entire outer circumference of the terminal attachment part 14C. A notch part 14E is formed in the central portion of the upper surface of the terminal attachment part 14C. Further, a rib 14F is provided in the upper surface of the lead-wire insertion part 14B to protrude upward and face the notch part 14E. When a lock member 12A (see FIG. 6) of a housing 12B is deformed, the tip part of the lock member 12A butts the rib 14F.

Coil-spring insertion parts 14G and 14G are provided in right and left lower portions of the lead-wire insertion part 14B, and coil springs 15 and 15 (see FIG. 2) as an elastic member are inserted into the coil-spring insertion parts 14G and 14G. As illustrated in FIG. 2, in the coil springs 15 and 15, one end is supported by an end wall part 13A of the outer housing 13, and the other end is supported by the bottom surface of the coil-spring insertion parts 14G and 14G. The coil springs 15 and 15 urges the inner housing 14 toward the front side in the fitting direction of the female connector 11.

Figure 6:
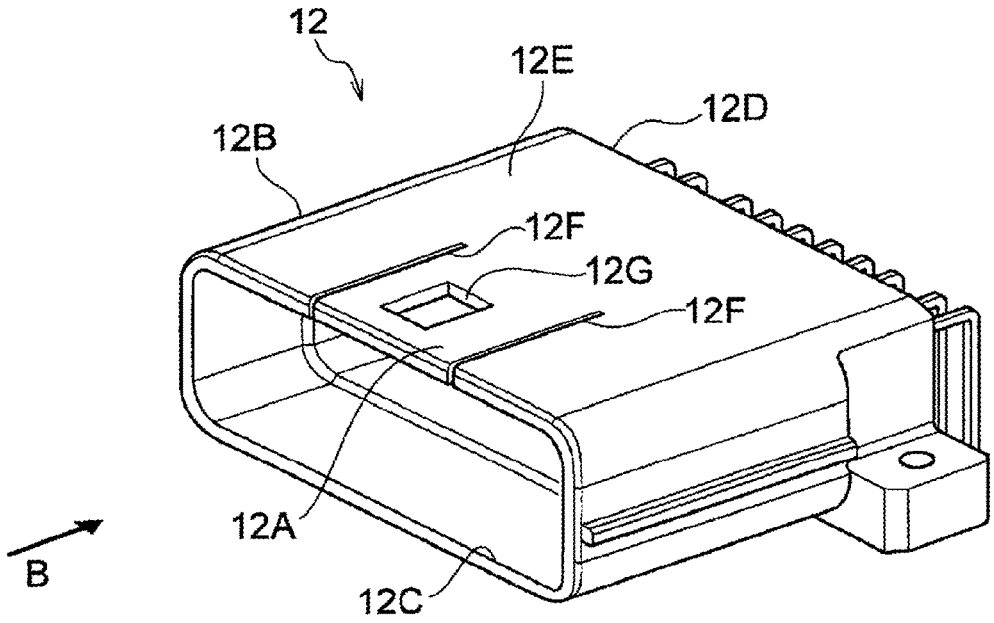
FIG. 6 is a perspective view of an appearance of a male connector including a housing.

FIG. 6 is a perspective view of an appearance of the male connector 12. The male connector 12 has the housing 12B having a bottomed tubular shape. In the housing 12B, an opening end 12C is provided on one side (the left side in the drawing) thereof, and the end wall 12D (see FIGS. 2 and 7) is provided on the other side (the right side in the drawing). In addition, the housing 12B is formed in a rectangular shape in which four corner parts are rounded when viewed from a direction of an arrow B. As illustrated in FIGS. 1 and 2, the male connector 12 is fitted to the female connector 11. At that time, the opening end 12C of the housing 12B is inserted into the opening end 13B of the outer housing 13, and the inner housing 14 is inserted into the opening end 12C of the housing 12B.

As illustrated in FIG. 6, two slits 12F and 12F which reach the opening end 12C are separately formed in the upper wall 12E of the housing 12B. Herein, the upper wall 12E forms a plate shape, and the slits 12F and 12F are formed to penetrate the upper wall 12E. With such a configuration, the portion of the slits 12F and 12F can be easily deformed elastically downward. Incidentally, the portion interposed between the slits 12F and 12F configures the lock member 12A.

In the lock member 12A, a penetration hole 12G as a hole part is formed in the almost central portion thereof, and the penetration hole 12G is provided to correspond to the projection 131 formed in the lower surface of the upper wall 13D of the outer housing 13. That is, the projection 131 can be engaged in the penetration hole 12G.

A plurality of male terminals 21 (see FIGS. 7A-7D) as a second terminal are provided in the inner surface (the bottom surface of the housing 12B) of the end wall 12D of the housing 12B.

Next, the effect of this embodiment is described with reference to FIGS. 7A-7D.

Figures 7A, 7B, 7C, 7D:
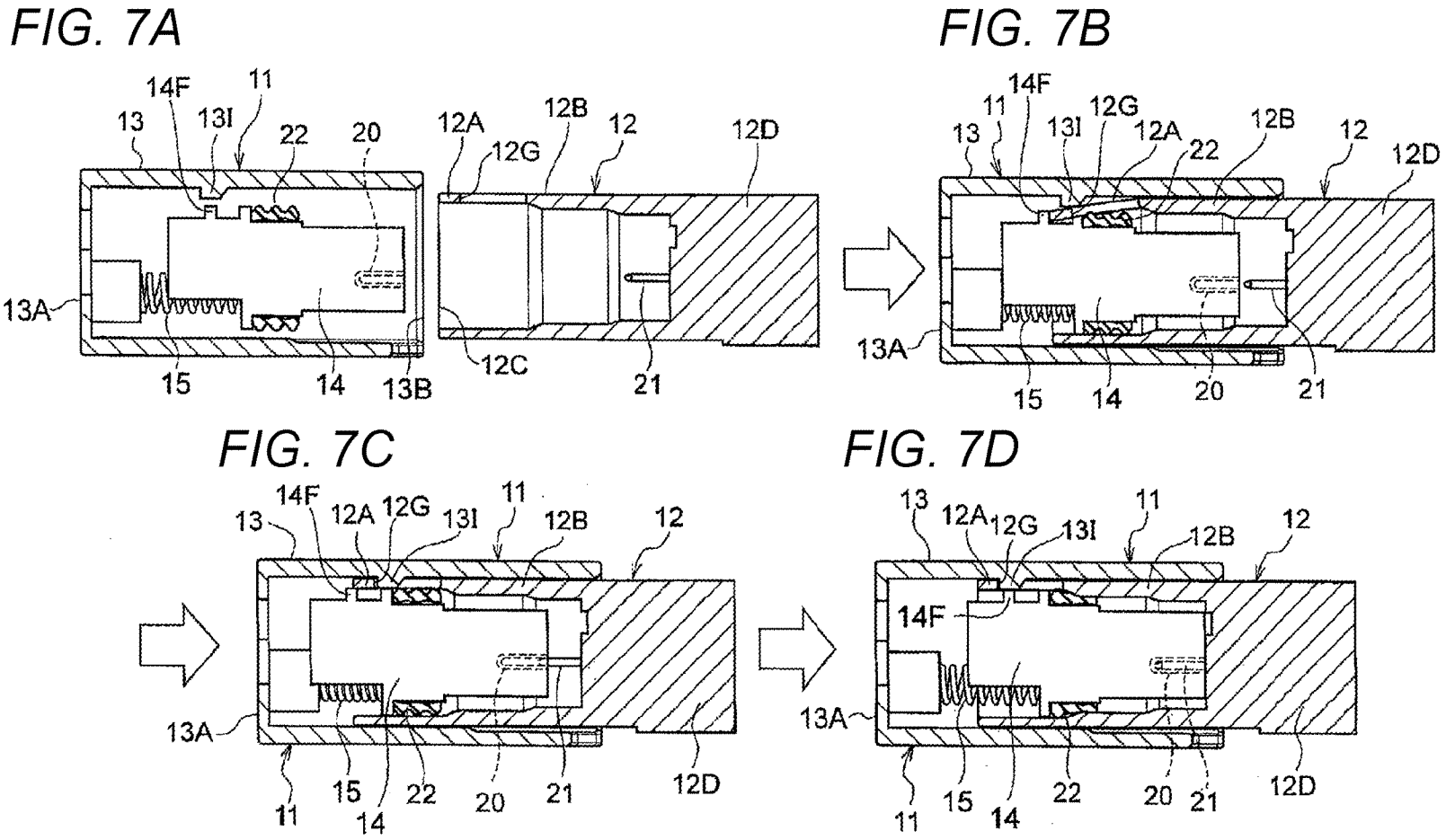

First, as illustrated in FIG. 7A, the inner housing 14 is housed in the outer housing 13 of the female connector 11. Further, the male connector 12 is arranged such that the opening end 12C of the housing 12B of the male connector 12 faces the opening end 13B of the outer housing 13.

Next, as illustrated in FIG. 7B, the male connector 12 is inserted into the female connector 11 against the urging force of the coil springs 15 and 15. At that time, the projection 131 provided in the outer housing 13 abuts on the lock member 12A of the housing 12B, and the lock member 12A is deformed to the central axis side of the housing 12B. In that case, since the side portion of the projection 131 is the inclined surface 13J (see FIG. 4), the lock member 12A can easily ride on the projection 131.

Incidentally, the state of FIG. 7B is a half-fitting state. Thus, when the insertion of the male connector 12 is released, the male connector 12 is pressed back by the urging force of the coil springs 15 and 15 to be deviated from the female connector 11.

When the lock member 12A is deformed as described above, the tip part of the lock member 12A butts the rib 14F provided in the outer surface of the inner housing 14, and the inner housing 14 is temporarily locked at the position.

As illustrated in FIG. 7C, when the male connector 12 is inserted, the position of the penetration hole 12G of the lock member 12A of the housing 12B matches that of the projection 131 of the outer housing 13. Thus, the lock member 12A returns elastically, and the projection 131 is engaged in the penetration hole 12G. Accordingly, the male connector 12 is fitted to the female connector 11.

At that time, the lock state of the inner housing 14 by the lock member 12A is released. Thus, as illustrated in FIG. 7D, the inner housing 14 is moved to the end wall 12D side (that is, the bottom portion side of the housing 12B) of the housing 12B by the urging force at the time of the coil springs 15 and 15 returning elastically. When the inner housing 14 is moved to the bottom portion side of the housing 12B as described above, the male terminal 21 below the housing 12B is pressed to the female terminal 20 in the inner housing 14. That is, the female terminal 20 and the male terminal 21 are connected to each other. Incidentally, in FIGS. 7A-7D, the female terminals 20 and the male terminals 21 are provided side by side in a direction perpendicular to the paper surface.

According to this embodiment, when the male connector 12 is fitted to the female connector 11, the timing of inserting the housing 12B of the male connector 12 to the outer housing 13 of the female connector 11 is deviated in time from the timing of pressing the male terminal 21 to the female terminal 20. Thus, the insertion force of the male connector 12 with respect to the female connector 11 is not generated simultaneously with the pressing force of the male terminal 21 with respect to the female terminal 20. As a result, it is possible to reduce the operating force at the time of fitting the male-side connector 12 to the female connector 11.

In this embodiment, the groove parts 13H and 13H are formed in the outer housing 13, and the engagement projections 14A and 14A which are engaged with the groove parts 13H and 13H are formed in the inner housing 14. Thus, the movement range of the engagement projections 14A and 14A is regulated by the groove parts 13H and 13H, and thus it can be prevented that the inner housing 14 which is urged by the coil springs 15 and 15 is deviated from the outer housing 13.

In this embodiment, when the male connector 12 is fitted to the female connector 11, the packing 22 is interposed between the outer surface of the inner housing 14 of the female connector 11 and the inner surface of the housing 12B of the male connector 12. Thus, it is possible to prevent that the water infiltrates into the portion in which the female terminal 20 or the male terminal 21 is provided.

In this embodiment, the slits 13E and 13E are provided in the end wall 13A and the upper wall 13D of the outer housing 13, and the operation hole 13F is provided between the slits 13E and 13E in the end wall 13A. Thus, when the human fingertip abuts on the operation hole 13F to pull up the portion between the slits 13E and 13E, and only the portion between the slits 13E and 13E in the upper wall 13D is deformed upward, so that the male connector 12 can be easily detached from the female connector 11.

Second Embodiment

Next, a second embodiment is described with reference to FIGS. 8A-8D.

In this embodiment, a conductive fitting detection member 25 which detects the conduction of at least one pair of adjacent male terminals 21 to detect the fitting state of the male connector 12 to the female connector 11 is provided in the inner housing 14 of the female connector 11. Incidentally, the fitting detection member 25 is formed by a spring-shaped member made of a metal.

Figures 8A, 8B, 8C, 8D:
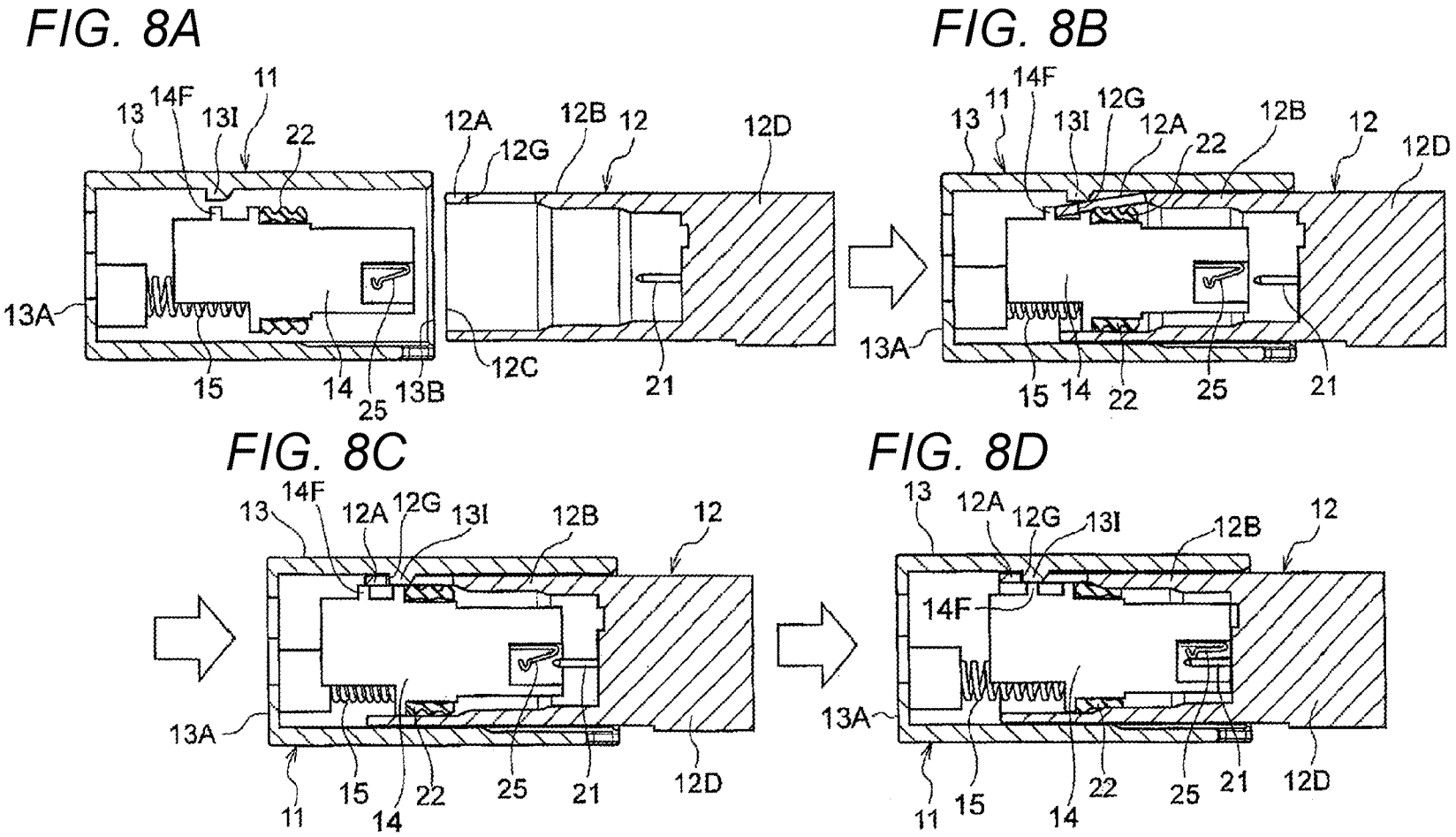

First, as illustrated in FIG. 8A, in the female connector 11, the inner housing 14 is housed in the outer housing 13. Further, the male connector 12 is arranged such that the opening end 12C of the housing 12B of the male connector 12 faces the opening end 13B of the outer housing 13.

Next, as illustrated in FIG. 8B, the male connector 12 is fitted to the female connector 11 against the urging force of the coil springs 15 and 15. At that time, the projection 131 provided in the outer housing 13 abuts on the lock member 12A of the housing 12B, and the lock member 12A is deformed to the central axis side of the housing 12B.

When the lock member 12A is deformed, the tip part of the lock member 12A butts the rib 14F provided in the outer surface of the inner housing 14, and the inner housing 14 is temporarily locked at the position.

As illustrated in FIG. 8C, when the male connector is inserted, the position of the penetration hole 12G of the lock member 12A of the housing 12B matches that of the projection 131 of the outer housing 13. Thus, the lock member 12A returns elastically. Accordingly, the projection 131 is engaged in the penetration hole 12G.

When the lock member 12A returns elastically, the lock state of the inner housing 14 by the lock member 12A is released. As illustrated in FIG. 8D, the inner housing 14 is moved to the end wall 12D side (that is, the bottom portion side of the housing 12B) of the housing 12B by the urging force of the coil springs 15 and 15.

When the inner housing 14 is moved to the bottom portion side of the housing 12B as described above, the male terminal 21 of the housing 12B is pressed to the female terminal 20 in the inner housing 14.

In that case, when a voltage is applied from the outside to the pair of adjacent male terminals 21 among the male terminals 21, and the pair of male terminals 21 are pressed to the fitting detection member 25 on the inner housing 14 side, it is detected whether a current flows between both male terminals 21. If the current flows, it is indicated that the pair of male terminals 21 completely contact the conductive fitting detection member 25, and it can be determined that the fitting state of the male connector 12 with respect to the female connector 11 is complete.

Incidentally, in this embodiment, the voltage is applied from the outside to the pair of adjacent male terminals 21. However, the invention is not limited thereto. The voltage may be applied to two male terminals 21 which are not adjacent, and the conduction between the male terminals 21 may be detected by the fitting detection member 25.

Hereinbefore, the embodiments of the invention have been described in detail with reference to the drawings. However, the embodiments are merely examples of the invention, and the invention is not limited only to the configuration of the embodiments. It is a matter of course that the modification or the like of the design which is made within the scope of the invention is also included in the invention.

For example, in the embodiments, the lock member 12A is formed between the pair of slits 13E and 13E. However, the invention is not limited thereto. The lock member 12A may be provided to protrude to the front side from the end wall 13A of the outer housing 13.

In the embodiments, the female terminal 20 is provided in the inner housing 14, and the male terminal 21 is provided in the housing 12B. However, the male terminal 21 may be provided in the inner housing 14, and the female terminal 20 may be provided in the housing 12B.

Herein, the features of the embodiments of the connector according to the invention will be simply summarized as the following (1) to (5).

(1) A connector (10) including:

a first connector (11) which includes a tubular outer housing (13) and an inner housing (14) received in the outer housing and in which a plurality of first terminals (20) are provided in the inner housing;

a second connector (12) which includes a counterpart housing (12B) having a bottomed tubular shape and configured to receive the inner housing at a time of being inserted into the outer housing (13) and in which a plurality of second terminals (21) are provided in an inner surface of a bottom portion of the counterpart housing; and an elastic member (15) which is provided in the outer housing and urges the inner housing toward a front side of the first connector in a fitting direction, wherein in a middle of fitting the first connector and the second connector, the second connector (12) retreats the inner housing (14) to a back surface of the first connector (11) in the fitting direction against an urging force of the elastic member (15), and wherein at a time of completely fitting the first connector and the second connector, the second connector allows the elastic member (15) to elastically return and moves the inner housing (14) in the fitting direction to the front side of the first connector (11), so that the inner housing (14) is guided toward the bottom portion of the counterpart housing (12B), and the first terminal (20) and the second terminal (21) are connected with each other.

(2) A connector (10) including:

a first connector (11) which includes a tubular outer housing (13) and an inner housing (14) received in the outer housing and in which a plurality of first terminals (20) are provided in the inner housing;

a second connector (12) which includes a counterpart housing (12B) having a bottomed tubular shape and configured to receive the inner housing at a time of being inserted into the outer housing (13) and in which a plurality of second terminals (21) are provided in an inner surface of a bottom portion of the counterpart housing;

an elastic member (15) which is provided in the outer housing and urges the inner housing toward a front side of the first connector in a fitting direction;

a first projection (13I) which is provided in an inner surface of the outer housing;

a second projection (14F) which is provided in an outer surface of the inner housing; and a lock member (12A) which is provided in an opening end of the counterpart housing, wherein in a middle of fitting the first connector and the second connector, the lock member (12A) abuts on the first projection (13I) so as to be deformed elastically in a direction toward the counterpart housing (12B) and butts the second projection (14F) to retreat the inner housing (14) to a back surface of the first connector in the fitting direction against an urging force of the elastic member (15), and wherein at a time of completely fitting the first connector and the second connector, the lock member receives the second projection (14F) in a hole part (12G) provided in the lock member so as to elastically return in a direction away from the counterpart housing (12B), and the lock member is released from butting the second projection (14F) such that the elastic member (15) is allowed to elastically return to move the inner housing (14) to the front side of the first connector (11), so that the inner housing (14) is guided toward the bottom portion of the counterpart housing (12B), and the first terminal (20) and the second terminal (21) are connected with each other.

(3) The connector according to (1) or (2), wherein the inner housing (14) includes a conductive fitting detection member (25) which detects a conduction of at least one pair of adjacent second terminals (21) to detect a fitting state of the first connector and the second connector.

(4) The connector according to any one of (1) to (3), wherein the outer housing (13) has a groove part (13H), and wherein the inner housing (14) includes an engagement projection (14A) which is engaged in the groove part to regulate a movement range of the inner housing.

(5) The connector according to any one of (1) to (4), further including:

a packing (22) which is arranged to be interposed between an outer circumferential surface of the inner housing (14) and an inner circumferential surface of the counterpart housing (12B) at the time of completely fitting the first connector and the second connector.

According to the connector of the invention, it is possible to reduce the operating force at the time of fitting the male connector to the female connector. The invention with such an effect is effectively applied to the connector.

The invention claimed is:

1. A connector comprising:

a first connector which comprises a tubular outer housing and an inner housing received in the outer housing and in which a plurality of first terminals are provided in the inner housing;

a second connector which comprises a counterpart housing having a bottomed tubular shape and configured to receive the inner housing at a time of being inserted into the outer housing and in which a plurality of second terminals are provided in an inner surface of a bottom portion of the counterpart housing;

an elastic member which is provided in the outer housing and urges the inner housing toward a front side of the first connector in a fitting direction; and a lock member which is provided in an opening end of the counterpart housing, wherein the outer housing comprises a mechanism configured to elastically deform the lock member in a direction toward the inner housing in a middle of fitting the first connector and the second connector, and to allow the lock member to elastically return in a direction away from the inner housing at a time of completely fitting the first connector and the second connector, wherein the inner housing comprises a lock part configured to be locked by the lock member which is begin elastically deformed in the middle of fitting the first connector and the second connector, and to be released from locking by the lock member when the lock member elastically returns at the time of completely fitting the first connector and the second connector, wherein in the middle of fitting the first connector and the second connector, the lock member retreats the inner housing to a back surface of the first connector in the fitting direction against an urging force of the elastic member by a lock of the locking member to the lock part, and wherein at the time of completely fitting the first connector and the second connector, the second connector allows the elastic member to elastically return and moves the inner housing in the fitting direction to the front side of the first connector by a release of the lock of the locking member to the lock part, so that the inner housing is guided toward the bottom portion of the counterpart housing, and the first terminal and the second terminal are connected with each other.

2. The connector according to claim 1, wherein the inner housing comprises a conductive fitting detection member which detects a conduction of at least one pair of adjacent second terminals to detect a fitting state of the first connector and the second connector.

3. The connector according to claim 1, wherein the outer housing has a groove part, and wherein the inner housing comprises an engagement projection which is engaged in the groove part to regulate a movement range of the inner housing.

4. The connector according to claim 1, further comprising:

a packing which is arranged to be interposed between an outer circumferential surface of the inner housing and an inner circumferential surface of the counterpart housing at the time of completely fitting the first connector and the second connector.

5. A connector comprising:

a first connector which comprises a tubular outer housing and an inner housing received in the outer housing and in which a plurality of first terminals are provided in the inner housing;

a second connector which comprises a counterpart housing having a bottomed tubular shape and configured to receive the inner housing at a time of being inserted into the outer housing and in which a plurality of second terminals are provided in an inner surface of a bottom portion of the counterpart housing;

an elastic member which is provided in the outer housing and urges the inner housing toward a front side of the first connector in a fitting direction;

a first projection which is provided in an inner surface of the outer housing;

a second projection which is provided in an outer surface of the inner housing; and a lock member which is provided in an opening end of the counterpart housing, wherein in a middle of fitting the first connector and the second connector, the lock member abuts on the first projection so as to be deformed elastically in a direction toward the inner housing and butts the second projection to retreat the inner housing to a back surface of the first connector in the fitting direction against an urging force of the elastic member, and wherein at a time of completely fitting the first connector and the second connector, the lock member receives the first projection in a hole part provided in the lock member so as to elastically return in a direction away from the inner housing, and the lock member is released from butting the second projection such that the elastic member is allowed to elastically return to move the inner housing to the front side of the first connector, so that the inner housing is guided toward the bottom portion of the counterpart housing, and the first terminal and the second terminal are connected with each other.

6. The connector according to claim 5, wherein the inner housing comprises a conductive fitting detection member which detects a conduction of at least one pair of adjacent second terminals to detect a fitting state of the first connector and the second connector.

7. The connector according to claim 5, wherein the outer housing has a groove part, and wherein the inner housing comprises an engagement projection which is engaged in the groove part to regulate a movement range of the inner housing.

8. The connector according to claim 5, further comprising:

a packing which is arranged to be interposed between an outer circumferential surface of the inner housing and an inner circumferential surface of the counterpart housing at the time of completely fitting the first connector and the second connector.

* * * * *